US005713272A

United States Patent [19]

Schaidl et al.

[11] Patent Number: 5,713,272

[45] Date of Patent: Feb. 3, 1998

[54] POWDER-PRESS WITH MECHANICAL-HYDRAULIC SHUTTLE CONTROL

[75] Inventors: Hubert Schaidl, Bichl; Walter Rau, Kochel am See; Hartmut Waffenschmidt, Ohlstadt; Alfred Eisensehr, Penzberg, all of Germany

[73] Assignee: Dorst-Maschinen und Anlagenbay Otto Dorst und Dipl-Lng Walter Schegel GmbH & Co, Kochel, Germany

[21] Appl. No.: 593,580

[22] Filed: Jan. 30, 1996

[30] Foreign Application Priority Data

Jan. 30, 1995 [DE] Germany ..... 195 02 841.4

[51] Int. Cl.[6] ..... B30B 15/30

[52] U.S. Cl. ..... 100/215; 425/258; 425/448

[58] Field of Search ..... 100/215, 216; 425/258, 448

[56] References Cited

U.S. PATENT DOCUMENTS

| | | | |
|---|---|---|---|
| 357,124 | 2/1887 | Gruson | 100/215 |
| 1,220,733 | 3/1917 | Duryea | 100/215 |
| 2,789,332 | 4/1957 | Scott | 425/448 |
| 2,893,101 | 7/1959 | Britner et al. | 425/448 |
| 3,285,095 | 11/1966 | Rockola . | |
| 3,456,465 | 7/1969 | Pax et al. . | |

FOREIGN PATENT DOCUMENTS

| | | | |
|---|---|---|---|
| 0399281 | 11/1990 | European Pat. Off. . | |
| 171822 | 6/1906 | Germany . | |
| 280157 | 11/1914 | Germany | 100/215 |
| 404466 | 10/1924 | Germany . | |
| 645161 | 5/1937 | Germany | 100/215 |
| 1020919 | 12/1957 | Germany . | |
| 6751221 | 1/1969 | Germany . | |
| 1452534 | 3/1969 | Germany . | |
| 2639090 | 3/1978 | Germany . | |
| 3826061 | 2/1990 | Germany . | |

*Primary Examiner*—Stephen F. Gerrity
*Attorney, Agent, or Firm*—Price, Heneveld, Cooper, DeWitt & Litton

[57] ABSTRACT

A powder press with mechanical-hydraulic shuttle control including a main press shaft, a control unit mounted on the powder press for converting rotational motion into translational motion, including a first actuator assembly; a second actuator assembly in fluid communication with the first actuator assembly; a shuttle assembly disposed at one end of the second actuator assembly; and a cardan shaft for transferring rotational motion of the main press shaft to the control unit. The control unit includes first and second shafts disposed in spaced relationship to each other; first and second wheels, each mounted on a respective one of the first and second shafts; a member interconnecting the first and second wheels in rotational engagement; and an adjustable cam member mounted on the second shaft and operatively engaging the first actuator assembly such that rotation of the main press shaft rotates the cardan shaft which, in turn, is coupled to the first shaft in the control unit. Rotation of the first shaft produces a corresponding rotation of the first wheel which, through the interconnecting member rotates the second wheel and shaft. The adjustable cam member mounted on the second shaft produces a linear motion in the first actuator assembly which produces a responsive motion in the second actuator assembly.

16 Claims, 3 Drawing Sheets

14
12
13
11
10
9
7

13
12
14
17
1
15
16
18
13
19
14
12
17
15
16

POWDER PRESS WITH MECHANICAL-HYDRAULIC SHUTTLE CONTROL

BACKGROUND OF THE INVENTION

1. Field of the Invention

The present invention pertains to powder presses for compressing and calibrating pressed parts of powdery material, especially ceramic powder and sintered metal.

2. Discussion of the Related Art

A well-known problem in the construction of presses for forming pressed parts of powdery material, especially of ceramic powder and sintered metal, is the cyclical filling of the press with the pressing powder by a filling device. If the filling device and/or the shuttle are not precisely controlled, this can lead to a bad filling or to a collision between the shuttle and the pressing ram during press operations. To avoid such problems, the shuttle control for the powder press must be constructed in such a way, that the cyclical movement of the shuttle, that is the start, duration, and end of the filling process, can be fixed exactly and without play.

State of the art powder press designs have filling devices which are controlled by the transfer of the rotation of the main press shaft as well as by a conversion to a translational movement. This is done by attaching to an extension on the main press shaft an adjustable cam disk, consisting of several segments, which rotates with the main press shaft. On the adjustable cam disk there is a pulley, which is fastened to the end of a lever arm, and this lever arm, in turn, is linked to a linkage assembly, for instance a parallel linkage. The rotational movement of the adjustable cam disk on the main press shaft is then converted by the pulley, the lever arm, as well as the parallel linkage into a translational movement and transferred to the filling device.

There are several basic disadvantages to such a powder press as described above. The extremely large bulk of the linkage assembly or the parallel linkage has to be moved in order to transport a few hundred grams of powdery material into the press. This results in an inordinate discrepancy between expenditure and usefulness. Moreover, because of the large number of individual components, a certain amount of play cannot be avoided in the whole transfer assembly for the shuttle. Slack in the transfer assembly from the cam disk to the shuttle can cause imperfect filling of the press as well as possible collisions between the shuttle and the pressing ram. Finally, because of the considerable bulk, setting the filling process parameters by adjusting the cam disk is a task that is tedious, cumbersome, and difficult to accomplish. Since the cam disk, and therefore also the adjusting mechanism for its segments, is directly placed on the main press shaft, and since the main press shaft is usually located in the lower machine area, that is to say, in the press pit, the adjustment process of the settings of the filling device is hampered even further.

Another familiar method is to operate the filling device of a powder press with a computer controlled installation, e.g. a step motor or an externally supplied hydraulic cylinder. In this method, there is no direct mechanical linkage between the main press drive and the drive for the filling device.

In spite of the undeniable advantages resulting from the elimination of mechanical transmission parts and the resulting bulk that has to be moved by them, several significant disadvantages become apparent even with this variety of powder press. Care has to taken with a computer controlled drive for the filling device of a powder press, especially with the pre-filling and post-filling process of the filling device, since that is where considerable collision danger between shuttle and pressing ram originates. Moreover, every position of the shuttle has to be determined with electronic path transmitters, so that the computer control unit of the filling device is always informed about the actual location of the shuttle. Such a powder press with a computer controlled drive of the filling device is based on precise and thus very costly programming of the control unit of the filling device, since it is impossible to establish direct synchronization with the movement processes of the press mechanisms by power flux.

The objective of the present invention is to devise a powder press for producing formed parts of powdery material which bypasses the disadvantages of the familiar state of the art technology; which enables an exact control of the filling device by linking that control to the main drive of the powder press; which permit easy setting of the filling process parameters; and which can be constructed of uncomplicated components.

SUMMARY OF THE INVENTION

According to the present invention, the provision is for a powder press for manufacturing pressed parts from powdery materials, especially ceramic powder and/or sintered metal, where a combination of mechanical and hydraulic components furnish the control of its filling device. The preferred method for this is by using a one-piece cardan shaft, which transfers the rotation of the main press shaft to the control unit, optimally in an easily accessible area at ground level of the press. Within the control unit there is a first shaft, to which the rotation of the cardan shaft, and thus also the rotation of the main press shaft, is transferred. A disk is located on the shaft in the control unit, where functionally the angle position of the disk relative to the shaft can be fixed within a defined area, preferably with the aid of a setting wheel. The recommended disk, arranged on the shaft, should be a pinion gear, but functionally a V-belt or a synchronous belt gear can also be used. Furthermore, on a second shaft within the control unit there is a cam disk, consisting of at least two segments, and this cam disk can be rotated on an axis parallel to that of the first-mentioned shaft of the control unit. The segments of the cam disk are also adjustable to one another, preferable with a setting wheel, so that different curved paths result. Also within the control unit there is an endlessly revolving transfer element, preferably a chain, but for that purpose it can also be a V-belt or a synchronous belt, which transfers the rotation of the disk on the first-mentioned shaft of the control unit to a second disk on the cam disk. Finally the control unit also contains a pressure cylinder, preferably a hydraulic cylinder, where a guide shoe or a wheel is fastened to the free end of the piston rod extending from the pressure cylinder. The pressure cylinder is so positioned within the control unit, that the guide shoe or in this case the roller of the piston rod runs along the contour of the cam disk. A resilient component, e.g. a spring, can be fastened between the pressure cylinder and the guide shoe or the roller, so that the guide shoe or the roller is forced to continuously follow the contour of the cam disk. In this method, the rotational movement of the cam disk and thus the rotation of the main press shaft is converted into a translational movement of the pressure cylinder piston rod. The pressure cylinder of the control unit is connected, preferably with a flexible pressure pipe, to a second pressure cylinder, while the free end of the piston rod extending outward from the second pressure cylinder is attached to a shuttle. Functionally, both pressure cylinders are linked in such a way, that the piston rod movement in the pressure cylinder of the control unit triggers a complimentary piston rod movement in the pressure cylinder of the shuttle, so that the rotation of the main press shaft is converted into a desired translational movement of the shuttle. Because of the connection between the two pressure cylinders with flexible pressure pipes, according to the present invention, it is possible to assemble the filling device of the powder press in such a way, that is can easily be removed from its operational mode and just as easily be re-deployed without necessitating assembly work on the motion transfer mechanism for the filling device. For this purpose, it is recommended, that the filling device, including the second pressure cylinder and the shuttle, is adjustable as to its height and optimally is situated on a table that can be folded aside, but it is possible to conceive of other assembly devices for the filling device that could replace the table.

A powder press like that in the invention solves the objectives in surprisingly simple and advantageous manner. By using pressure cylinders and connecting them with flexible pressure pipes, the movable bulk controlling the filling device is significantly reduced. Yet the synchronization of the movement of the pressing ram and the filling device with the main press shaft remains ensured through the use of the pressure cylinders with a cam disk and the transfer of the rotation of the main press shaft to the cam disk. Moreover, by transferring the rotation of the main press shaft with a cardan shaft to the control unit of the filling device, setting the filling process parameters is made considerably easier for the operators. Decoupling the setting of the duration of the filling process as well as the location of the filling processes from the cycle, once through the position of the disk on the first shaft of the control unit and then through the adjustable segments of the cam disk, simplifies the setting and enables better visualization of the set parameters.

BRIEF DESCRIPTION OF THE DRAWING FIGURES

The following enclosed drawings are used to describe a preferred construction model of the present invention. The corresponding drawings show in:

FIG. 1 the frontal view of a powder press as set forth in the invention;

FIG. 2 a side view of a powder press like that in FIG. 1;

FIG. 3 a side section of the control unit of a powder press like that in FIGS. 1 and 2;

FIG. 4 a frontal section of the control unit of a powder press like that in FIGS. 1 and 2;

FIG. 5 a schematic representation of the hydraulic control installation of the filling device of a powder press as set forth in the present invention;

FIG. 6 the side view of an assembly layout of a height-adjustable shuttle with pressure cylinder in a preferred construction model of the present invention; and FIG. 7 the top view of assembly layout according to FIG. 6.

DETAILED DESCRIPTION OF THE INVENTION

Figure 1:
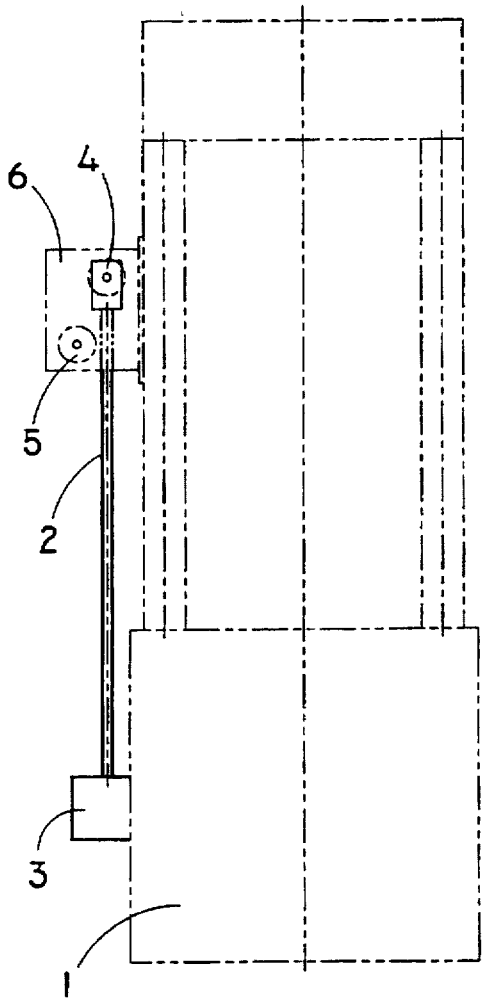

In FIG. 1 a powder press 1 according to the invention is represented, with a cardan shaft 2, with is linked rotationally with an extension 3 of the main press shaft, while the cardan shaft 2 is also linked rotationally to a control unit 6, which, in this construction model, is at operational height and is located at the side of the powder press. As shown in FIG. 1, the control unit 6 is furnished with a setting wheel 4 for setting the duration of the filling process, as well as with a setting wheel 5 for setting the location of the filling process within the cycle.

Figure 2:
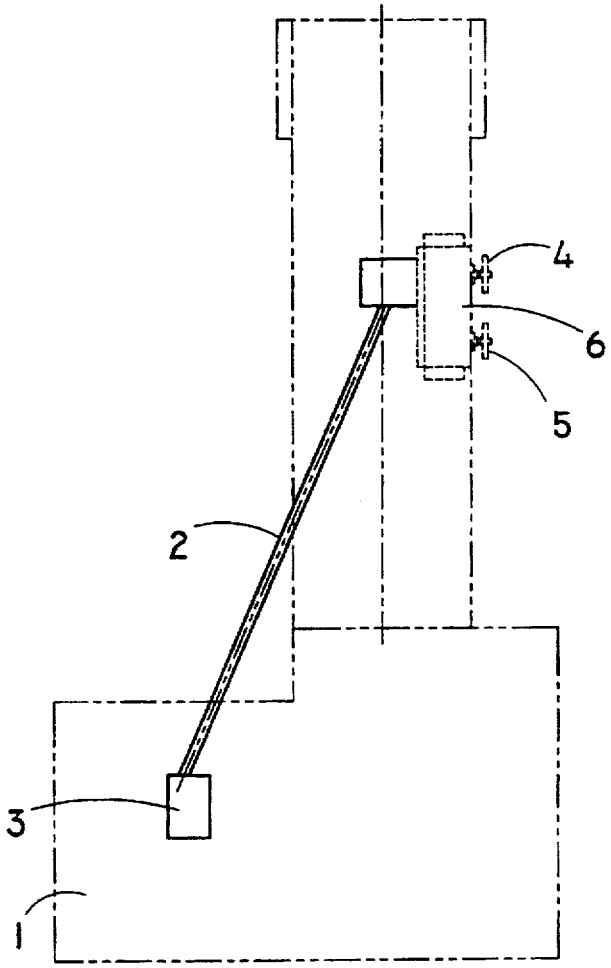

In FIG. 2 the same powder press as FIG. 1 is shown, but the position of the elements: cardan shaft 2, main press shaft extension 3, control unit 6, as well as setting wheels 4 and 5 can be seen more readily.

Figure 3:
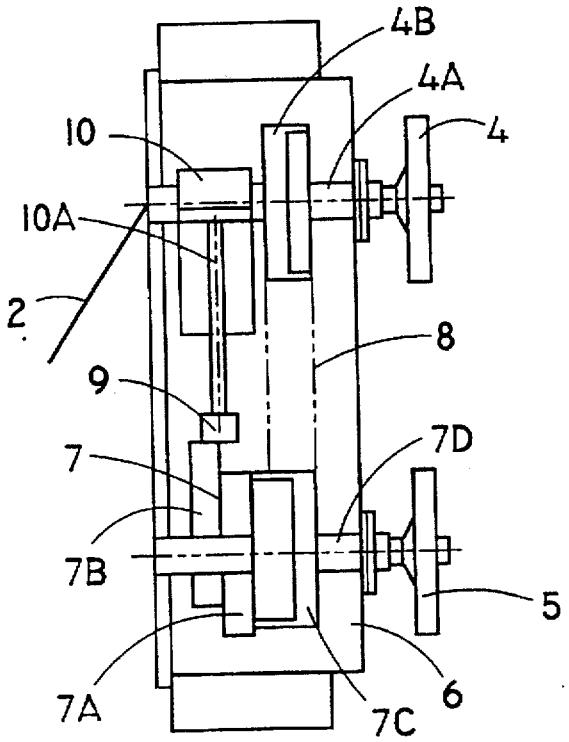

In FIG. 3 a sectional side view of the control unit of a powder press, according to the invention, is represented, where a shaft 4*a* can be seen, which rotates with the rotational speed of the cardan shaft 2 of FIGS. 1 and 2; a wheel 4*b*, the angle position of which in relationship to the shaft 4*a* can be altered with a setting wheel 4; a wheel 7*c*, which drives the cam disk consisting of segments 7*a* and 7*b*; a chain 8, which transfers the rotation of wheel 4*b* to the wheel 7*c*; a guide shoe or a roller 9, which runs along the contour of the cam disk 7 and with a piston rod 10*a* affects a pressure cylinder 10 in the control unit, while the location of the segments 7*a* and 7*b* of the cam disk 7, relative to each other, is adjustable with the setting wheel 5.

Figure 4:
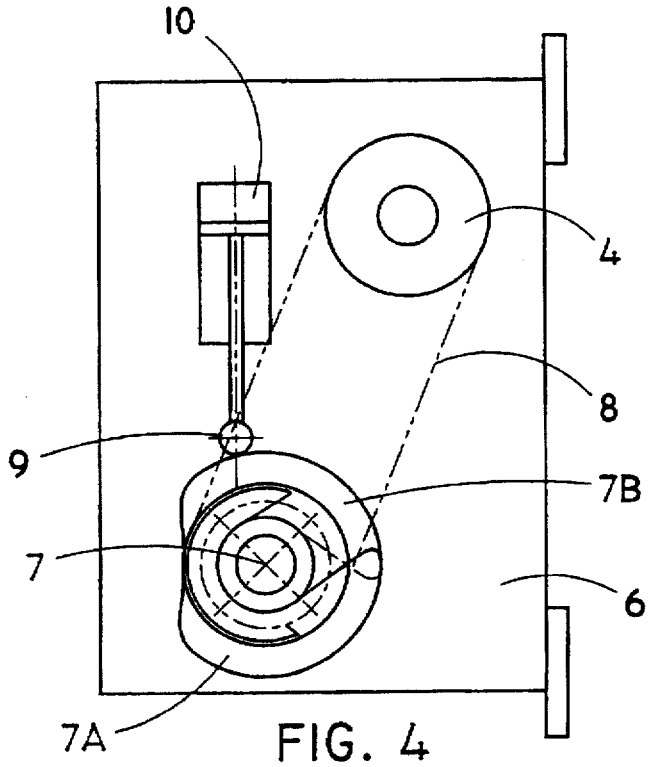
Figures 5, 6, 7:
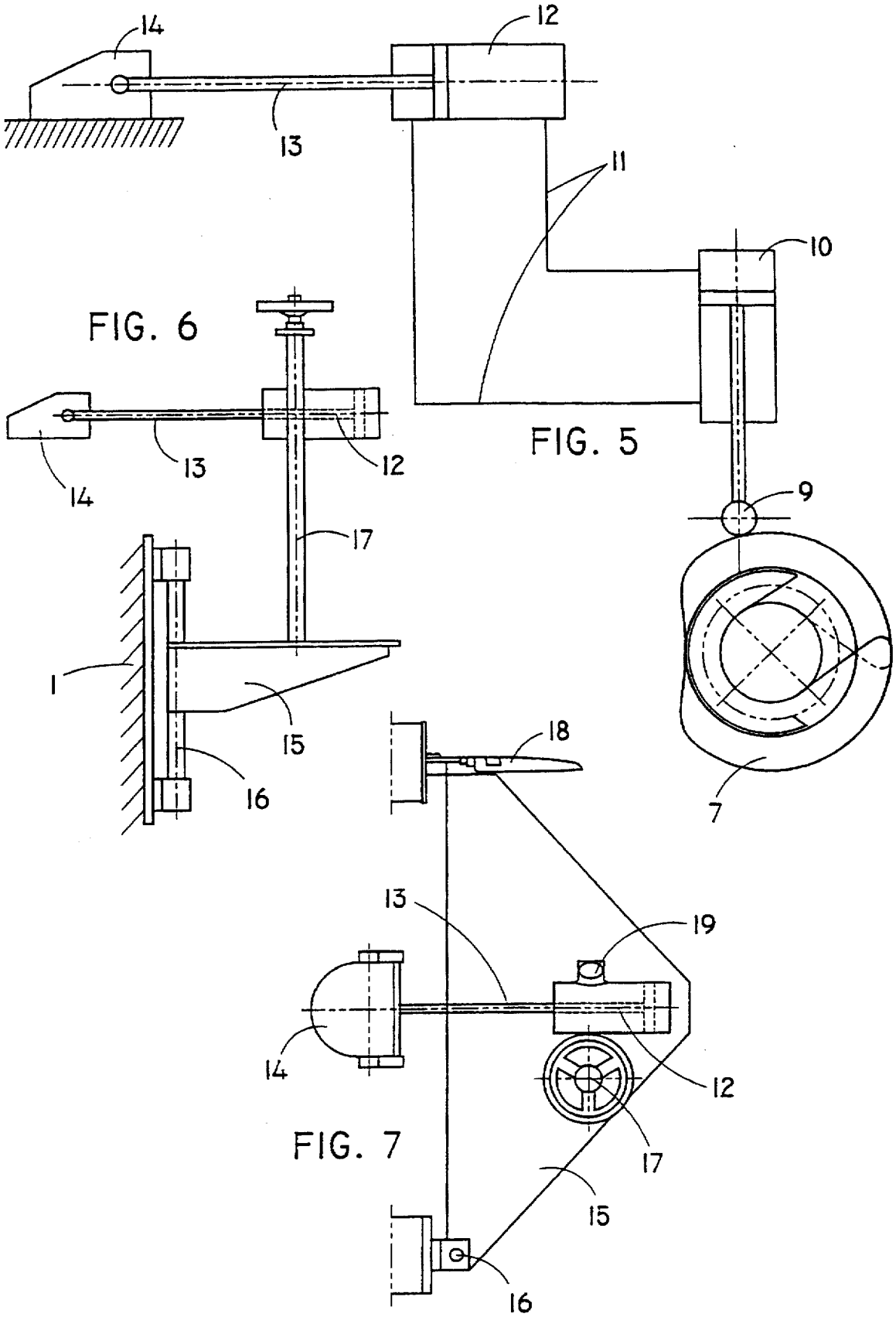

FIG. 4 shows the same elements as FIG. 3, but in a front sectional view. In FIG. 5 is shown a schematic representation of the filling control between cam disk 7 in the control unit and shuttle 14 of the filling device. Pressure pipes 11, connecting the pressure cylinder 10 of the control unit with pressure cylinder 12 in the filling device, can be seen beyond the already familiar elements from FIGS. 3 and 4. The shuttle 14, which loads the material into the press to be compressed, is located on free outward extending end 13 of the piston rod of the pressure cylinder 12. When the guide shoe 9 follows along the contour of the cam disk 7, the shuttle is forced into a translational movement by the pressure cylinders 10 and 12, as well as the pressure pipes 11 linking the pressure cylinders.

FIG. 6 shows the assembly layout of the filling device of a preferred construction model of the powder press, according to the invention, where the shuttle 14, the piston rod 13, as well as the pressure cylinder 12 are arranged, adjustable in height via a spindle 17, on a table, which in turn is linked with a shaft 16 to the press 1 and can be folded aside.

In FIG. 7 is depicted in top view, beyond the elements shown in FIG. 6, a guide rod 19 for the exact positioning of the filling device, which includes the shuttle 14, the piston rod 13, as well as the pressure cylinder 12, as well as a suspendable connection 18, which in operational mode fixes the table 15 in folded position. If the element 18 is released, the table 15 can be folded along the shaft 16, so that the whole assembly unit with the filling device can be folded to the outside.

We claim:

1. A press for manufacturing pressed parts from a powdery material, with a filling device, the press having a main shaft comprising:

a control unit mounted with respect to the press and having rotational elements;

a mechanism interconnecting said main shaft to a first of said rotational elements in said control unit; and a hydraulic device operably coupled to a second of said rotational elements within said control unit for converting rotational movement of said main shaft, said mechanism, and said first of said rotational elements into a translational movement of said filling device.

2. A press according to claim 1, wherein said rotational elements of said control unit includes:

a first wheel on a first shaft;

a second wheel on a second shaft;

a connecting element for linking said first wheel on said first shaft to said second wheel on said second shaft;

a cam disk driven by said second wheel wherein said mechanism interconnecting said main shaft to said first of said rotational elements in said control unit includes a cardan shaft; and an extension of the main press shaft transfers rotation of the main shaft to said cardan shaft.

3. A press according to claim 2, wherein said control unit is located at a level for easy access to the press.

4. A press according to claim 3, wherein said first wheel on said first shaft in said control unit is angularly adjustable through a setting wheel, and said cam disk includes two segments, a position of which in relation to one another can be changed with a second setting wheel.

5. A press according to claim 1, wherein said hydraulic device includes:

at least two linear actuators interconnected by flexible pressure pipes and each having an outwardly extending end of a first piston rod; and disposed at one end of one of said linear actuators is at least one of a guide shoe and a roller which runs along a contour of said cam disk in said control unit, and attached to a free, outwardly extending end of a second piston rod of a second of said two linear actuators is a shuttle for filling the powder press.

6. A press according to claim 5, wherein the filling device, including individual elements of said shuttle, said second piston rod, and said second linear actuator are located on an assembly table, which is adjustable in height.

7. A press according to claim 6, wherein said assembly table is linked to the press and is foldable, so that said assembly table, including the filling device, can be folded away from an operational mode.

8. A press according to claim 7, wherein, in said operational mode, said assembly table is fixed in a folded position by a removable connection.

9. A press according to claim 8, further comprising a height adjustment of the filling device located on said assembly table and includes a spindle and a guide rod.

10. A press assembly for manufacturing components from a powder, comprising in combination:

a main press shaft;

a cardan shaft having first and second ends, said first end pivotally coupled to said main press shaft;

a control unit mounted on said press assembly and having a first shaft pivotally coupled to said second end of said cardan shaft;

a second shaft disposed within said control unit and spaced from said first shaft;

an element for linking said first shaft and said second shaft;

a cam disk attached to said second shaft;

a first actuator assembly operatively engaging said cam disk;

a second actuator assembly in fluid communication with said first actuator assembly, and having an actuator shaft; and a shuttle assembly attached to said actuator shaft.

11. A powder press assembly, comprising in combination:

a main press shaft;

control means mounted on the powder press assembly for converting rotational motion of said main press shaft into translational motion, including a first actuator assembly;

a second actuator assembly in fluid communication with said first actuator assembly;

a shuttle assembly disposed at one end of said second actuator assembly;

and wherein said control means includes means for transferring rotational motion of said main press shaft to said control means; and wherein said control means includes first and second shafts disposed in spaced relationship; first and second wheels mounted on a respective one of said first and second shafts; means for interconnecting said first and second wheels in rotational engagement; and an adjustable cam member mounted on said second shaft and operatively engaging said first actuator assembly.

12. The powder press as defined in claim 11, wherein said first actuator assembly includes a linear actuator having a first end engaging an edge of said adjustable cam member, and a second end mounted in sliding engagement within a cylinder.

13. The powder press as defined in claim 11, wherein said second actuator assembly includes a linear actuator having a first end mounted in sliding engagement within a cylinder and a second end attached to said shuttle assembly.

14. The powder press as defined in claim 11, wherein said shuttle assembly includes a filling device for dispensing a powder material into a cavity defined within the powder press and configured for translational movement thereon between a first and second position.

15. The powder press as defined in claim 11, wherein said first actuator and said second actuator are interconnected by at least two hydraulic lines such that a movement of said first actuator assembly results in a responsive motion of said second actuator assembly.

16. The powder press as defined in claim 11, wherein said means for transferring rotational motion of said main press shaft to said control means includes a cardan shaft having a first end coupled to said main press shaft and a second end coupled to said first shaft of said control means.

* * * * *

UNITED STATES PATENT AND TRADEMARK OFFICE

CERTIFICATE OF CORRECTION

PATENT NO. : 5,713,272
DATED : FEBRUARY 3, 1998
INVENTOR(S) : HUBERT SCHAIDL, WALTER RAU, HARTMUT WAFFENSCHMIDT and ALFRED EISENSEHR It is certified that error appears in the above-identified patent and that said Letters Patent is hereby corrected as shown below:

Title page, item [73]
Assignee : should read --.

"Schegel" should be --Schlegel--.

Signed and Sealed this

Nineteenth Day of May, 1998

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,713,272
DATED : February 3, 1998
INVENTORS : Hubert Schaidl, Walter Rau, Hartmut Waffenschmidt and Alfred Eisensehr It is certified that error appears in the above-identified patent and that said Letters Patent is hereby corrected as shown below:

Cover page:

Assignee

"Dorst-Maschinen und Anlagenbay
Otto Dorst und Dipl-Lng Walter
Schegel GmbH & Co, Kochel, Germany"

should be:

--Dorst-Maschinen und Anlagenbau
Otto Dorst und Dipl.-Ing. Walter
Schlegel GmbH & Co. Kochel, Germany--.

Signed and Sealed this

Sixteenth Day of June, 1998

*Attest:*

Bruce Lehman

BRUCE LEHMAN

*Attesting Officer*

*Commissioner of Patents and Trademarks*